US009896748B2

(12) United States Patent
Koo et al.

(10) Patent No.: US 9,896,748 B2
(45) Date of Patent: Feb. 20, 2018

(54) LOW YIELD RATIO DUAL PHASE STEEL LINEPIPE WITH SUPERIOR STRAIN AGING RESISTANCE

(75) Inventors: Jayoung Koo, Sommerset, NJ (US); Narasimha-Rao V. Bangaru, Pittstown, NJ (US); Swarupa Soma Bangaru, legal representative, Annadale, NJ (US); Hyun-Woo Jin, Easton, PA (US); Adnan Ozekcin, Bethlehem, PA (US); Raghavan Ayer, Basking Ridge, NJ (US); Douglas P. Fairchild, Sugar Land, TX (US); Danny L. Beeson, Houston, TX (US); Douglas S. Hoyt, The Woodlands, TX (US); James B. LeBleu, Jr., Houston, TX (US); Shigeru Endo, Tokyo (JP); Mitsuhiro Okatsu, Tokyo (JP); Shinichi Kakihara, Tokyo (JP); Moriyasu Nagae, Tokyo (JP)

(73) Assignee: Exxon Mobil Upstream Research Company, Houston, TX (US)

( * ) Notice: Subject to any disclaimer, the term of this patent is extended or adjusted under 35 U.S.C. 154(b) by 0 days.

(21) Appl. No.: 13/361,774

(22) Filed: Jan. 30, 2012

(65) Prior Publication Data

US 2012/0125490 A1 May 24, 2012

Related U.S. Application Data

(62) Division of application No. 12/418,767, filed on Apr. 6, 2009, now abandoned.

(51) Int. Cl.

| | |
|---|---|
| ***C21D 8/10*** | (2006.01) |
| ***C22C 38/02*** | (2006.01) |
| ***C21D 6/00*** | (2006.01) |
| ***C21D 8/02*** | (2006.01) |
| ***C21D 9/14*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *C22C 38/02* (2013.01); *C21D 6/005* (2013.01); *C21D 8/0226* (2013.01); *C21D 8/0263* (2013.01); *C21D 9/14* (2013.01); *C22C 38/04* (2013.01); *C22C 38/08* (2013.01); *C22C 38/12* (2013.01); *C22C 38/14* (2013.01); *C22C 38/16* (2013.01); *C21D 2211/002* (2013.01); *C21D 2211/005* (2013.01); *C21D 2211/008* (2013.01)

(58) Field of Classification Search

CPC ..... C22C 38/02; C22C 38/04; C22C 38/08; C22C 38/12; C22C 38/14; C22C 38/16; C21D 6/005; C21D 8/0226; C21D 8/0263; C21D 9/14; C21D 2211/002; C21D 2211/005; C21D 2211/008

USPC ..... 148/320, 330, 336, 519, 537, 593, 624, 148/645; 420/126, 128

See application file for complete search history.

(56) References Cited

U.S. PATENT DOCUMENTS

| | | | |
|---|---|---|---|
| 5,531,842 | A | 7/1996 | Koo et al. |
| 5,545,269 | A | 8/1996 | Koo et al. |
| 5,545,270 | A | 8/1996 | Koo et al. |
| 5,653,826 | A | 8/1997 | Koo et al. |
| 5,900,075 | A | 5/1999 | Koo et al. |
| 6,149,969 | A | 11/2000 | Gibson |
| 6,565,678 | B2 | 5/2003 | Fairchild et al. |
| 6,648,209 | B2 | 11/2003 | Hohl et al. |
| 8,070,887 | B2 | 12/2011 | Asahi et al. |
| 2004/0050445 | A1 | 3/2004 | Ohgami et al. |
| 2004/0144454 | A1 | 7/2004 | Jeong et al. |
| 2006/0201592 | A1 | 9/2006 | Ishikawa et al. |
| 2007/0193666 | A1* | 8/2007 | Asahi ..... B32B 15/01 148/654 |

FOREIGN PATENT DOCUMENTS

| | | |
|---|---|---|
| EP | 1325967 A1 | 7/2003 |
| JP | H10-017982 | 1/1998 |

(Continued)

OTHER PUBLICATIONS

Tsuru et al., "Improved Collapse Resistance of UOE Line Pipe with Thermal Aging for Deepwater Applications", May 25-Jun. 2, 2006, Proceedings of the Sixteenth International Offshore and Polar Engineering Conference, The International Society of Offshore and Polar Engineers, p. 187.*

Atkins et al., "Atlas of Continuous Cooling Transformation Diagrams for Engineering Steels" American Society for Metals, 1980 (pp. 10-16, 153).

Trzaska et al., "The calculation of CCT diagrams for engineering steels," Archives of Materials Science and Engineering, vol. 39, Issue 1 Sep. 2009 (pp. 13-20).

(Continued)

*Primary Examiner* — Jessee Roe

(74) *Attorney, Agent, or Firm* — Baker Botts L.L.P.

(57) ABSTRACT

A steel composition and method from making a dual phase steel therefrom. The dual phase steel may have carbon of about 0.05% by weight to about 0.12 wt %; niobium of about 0.005 wt % to about 0.03 wt %; titanium of about 0.005 wt % to about 0.02 wt %; nitrogen of about 0.001 wt % to about 0.01 wt %; silicon of about 0.01 wt % to about 0.5 wt %; manganese of about 0.5 wt % to about 2.0 wt %; and a total of molybdenum, chromium, vanadium and copper less than about 0.15 wt %. The steel may have a first phase consisting of ferrite and a second phase having one or more of carbide, pearlite, martensite, lower bainite, granular bainite, upper bainite, and degenerate upper bainite. A solute carbon content in the first phase may be about 0.01 wt % or less.

37 Claims, 5 Drawing Sheets

(56) References Cited

FOREIGN PATENT DOCUMENTS

| | | | |
|---|---|---|---|
| JP | H10-259448 | | 9/1998 |
| KR | 10-2003-0081050 | A | 4/2003 |
| KR | 10-2004-0005675 | A | 1/2004 |
| WO | WO1996017964 | A1 | 6/1996 |
| WO | WO1996017965 | A1 | 6/1996 |
| WO | WO1996017966 | A1 | 6/1996 |
| WO | WO1998038345 | A1 | 9/1998 |
| WO | WO1999002747 | A1 | 1/1999 |
| WO | WO2008045631 | A2 | 4/2008 |
| WO | WO2008045631 | A3 | 4/2008 |

OTHER PUBLICATIONS

International Preliminary Report on Patentability, dated Apr. 23, 2009.

Supplementary European Search Report for Application No. EP 07841597, dated Aug. 30, 2011.

Office Action in U.S. Appl. No. 12/418,767, dated Oct. 31, 2011.

Office Action issued in related Korean Patent Application No. 2009-7008671, dated Apr. 4, 2014, 9 pages.

Office Action in Japanese Patent Application No. 2009-531512 dated Jan. 15, 2013.

* cited by examiner

LOW YIELD RATIO DUAL PHASE STEEL LINEPIPE WITH SUPERIOR STRAIN AGING RESISTANCE

CROSS-REFERENCE TO RELATED APPLICATIONS

This application is a divisional application of U.S. patent application Ser. No. 12/418,767, filed on Apr. 6, 2009, which is a U.S. National Stage Application of International Application No. PCT/US2007/77202 filed Aug. 30, 2007, which is incorporated herein by reference in its entirety, and which claims the benefit of U.S. Provisional Application No. 60/850,216 filed on Oct. 6, 2006.

BACKGROUND

The present invention relates, in general, to linepipe and more particularly to low yield ratio, dual phase steel linepipe having a superior strain aging resistance and methods for making the same.

Natural gas is becoming an increasingly important energy source. Often the major natural gas fields in the world are far removed from major markets. As such, pipelines may have to traverse long distances over land or under water, which can cause severe strains on the pipeline. Seismically active regions and arctic regions that are subject to frost-heave and thaw settlement cycles can cause severe strains on a pipeline. Pipelines laid across sea beds also experience severe strains due to displacement or bending caused by water currents.

Accordingly, linepipe used for these environments requires excellent strain capacity, such as excellent uniform elongation and a low yield to tensile strength ratio or yield ratio (YR) in the longitudinal direction of pipe to ensure mechanical integrity. Dual phase (DP) steel has a relatively soft phase, such as a ferrite phase and a relatively hard phase. The harder phase usually has more than one constituent. Dual phase steels (i.e. steel having a dual phase (DP) microstructure) offer high uniform elongation and low yield ratios and thus, provide superior strain capacity. For these reasons, DP steel linepipe is attractive for installation in seismically active areas or in arctic regions subject to semi-perma frost conditions or in other situations which demand high strain capacity.

DP steel is typically processed according to a series of steps. For example, a steel slab is typically re-heated to an austenite temperature range of about 1,000° C. to 1250° C., and rough rolled within a recrystallization temperature range to refine the grain size. The rough-rolled steel is then finish rolled within a non-recrystallization temperature range, and cooled to a temperature below $Ar_3$ to form ferrite followed by accelerated cooling to a temperature of 400° C. or less. The plate is then typically worked into a U shape, then an O shape, seam welded, and expanded (known as UOE pipe making process) to the desired outer diameter. Arc welding, resistance welding or laser welding or the like can be used for the seam welding step in the UOE process.

Afterwards, the outer diameter of the pipe is typically coated to provide protection against corrosion. Fusion bonded epoxy (FBE) coating is typically used for this purpose. During the FBE coating process, the pipe is heated to an elevated temperature and coated with a polymer.

Due to the linepipe fabrication and coating processes, most linepipe steels including DP steels are susceptible to strain aging. Strain aging leads to a degradation of strain capacity, and is a type of behavior, usually associated with yield point phenomena, in which the flow or yield strength of a metal is increased and the ductility is decreased upon heating after cold working, such as during the FBE coating process. In other words, strain aging refers to the hardening of metals with a corresponding decrease in ductility.

Strain aging can be caused by the interaction between the stress field of dislocations and the strain field of solute atoms in the steel. The formation of solute atmospheres ("Cottrell atmospheres") around dislocations increases the resistance to dislocation movement on subsequent loading. Ductility in metals is generally proportional to the ease with which dislocations move in that metal. As a result, higher forces or stress is required to tear the dislocations away from the Cottrell atmospheres, leading to an increase of yield strength, loss of ductility and increase in ductile-to-brittle transition temperature. The net result is that strain aging reduces strain capacity. A steel or component fabricated out of that steel with higher resistance to strain aging will therefore substantially retain its strain capacity after aging following cold working.

The aging process is thought to occur in two stages. In the first stage, solute species diffuse to the dislocations to form atmospheres. In the second stage, the solute species form precipitates on the dislocations. Those precipitates contribute to the overall strength increase of the material but lower the elongation to fracture. Often, only the first stage occurs if there is a low concentration of solute species.

The elements typically responsible for relatively low temperature (≤300° C.) strain aging in steel are carbon and nitrogen, which are interstitial solute elements in steel. Those elements have low equilibrium solubility and significantly higher diffusivities compared to that of substitutional solutes within the steel, such as chromium, vanadium, molybdenum, copper, and magnesium, just to name a few. However, carbide and nitride forming substitutional alloying elements such as chromium, vanadium, molybdenum, etc. can have an indirect effect on strain aging susceptibility by increasing the equilibrium solubility of carbon and nitrogen. As such, solute carbon and nitrogen have a tendency to migrate to dislocations in the ferrite phase forming the Cottrell atmospheres. As mentioned above, these Cottrell atmospheres tend to restrict the motion of dislocations and therefore, compromise the strain capacity of the steel.

Similarly, it is believed that the yield strength of dual phase steel linepipe can be increased during post-formation treatments, such as the FBE coating process. As mentioned, a typical FBE coating process requires heat. The thermal exposure required by the FBE coating process provides enough energy for the solid solution carbon and/or nitrogen atoms in the linepipe to migrate to the dislocations in the ferrite phase. That migration compromises the strain capacity of the linepipe for the reasons stated above.

There is a need, therefore, for a dual phase steel and linepipe made therefrom that have a low yield ratio, high uniform elongation and excellent work hardening properties for high strain capacity to ensure mechanical integrity in aggressive environment applications. There is also a need for new steel chemistries that will impart excellent strain aging resistance to the steel and products fabricated therefrom. Further, there is a need for a method to process dual phase steel, which provides superior strain aging resistance attributes in the linepipe and the precursor steel from which it is fabricated for excellent strain capacity, particularly after a thermal treatment process such a FBE coating process.

SUMMARY

The present invention relates, in general, to linepipe and more particularly to low yield ratio, dual phase steel linepipe having a superior strain aging resistance and methods for making the same.

In one embodiment, the present invention is directed to a steel composition and methods for making a dual phase steel therefrom. In at least one embodiment, the dual phase steel comprises carbon in an amount of about 0.05% by weight to about 0.12 wt %; niobium in an amount of about 0.005 wt % to about 0.03 wt %; titanium in an amount of about 0.005 wt % to about 0.02 wt %; nitrogen in an amount of about 0.001 wt % to about 0.01 wt %; silicon in an amount of about 0.01 wt % to about 0.5 wt %; manganese in an amount of about 0.5 wt % to about 2.0 wt %; and a total of molybdenum, chromium, vanadium and copper less than about 0.15 wt %. The steel has a first phase consisting of ferrite and a second phase comprising one or more constituents selected from the group consisting of carbide, pearlite, martensite, lower bainite, granular bainite, upper bainite, and degenerate upper bainite. A solute carbon content in the first phase is about 0.01 wt % or less.

In one exemplary embodiment, the method for making the dual phase steel comprises heating a steel slab to a reheating temperature from about 1,000° C. to about 1,250° C. to provide a steel slab consisting essentially of an austenite phase. The steel slab is reduced to form a plate in one or more hot rolling passes at a first temperature sufficient to recrystallize the austenite phase. The plate is reduced in one or more hot rolling passes at a second temperature wherein the austenite does not recrystallize to produce a rolled plate. The second temperature is below the first temperature. The rolled plate is then cooled to a first cooling temperature sufficient to induce austenite to ferrite transformation, and then the cluster forming atoms within the ferrite are reduced.

In yet another embodiment, the method for making the dual phase steel comprises heating a steel slab to about 1,000° C. to about 1,250° C. to provide a steel slab consisting essentially of an austenite phase. The steel slab is reduced to form a plate in one or more hot rolling passes at a temperature sufficient to recrystallize the austenite phase to produce a fine grained austenite phase. The plate is further reduced in one or more hot rolling passes at a temperature below a temperature where austenite does not recrystallize. The plate is cooled to a first temperature sufficient to induce austenite to ferrite transformation and quenched at a rate of at least 10° C. per second (18° F./sec) to a second temperature. The plate is then cooled at a rate sufficient to reduce solute carbon in the ferrite.

The features and advantages of the present invention will be apparent to those skilled in the art from the description of the preferred embodiments which follows when taken in conjunction with the accompanying drawings. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION

Figure 1:
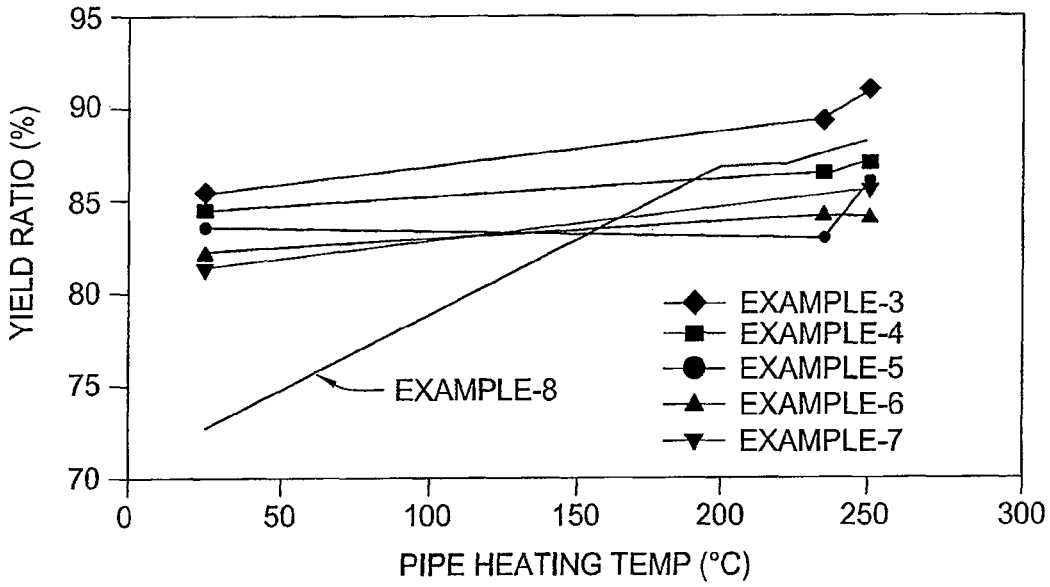
FIGS. 1-4 are illustrate the variations of mechanical properties of certain illustrative steels produced according to one or more embodiments of the present invention.

The present invention relates, in general, to linepipe and more particularly to low yield ratio, dual phase steel linepipe having a superior strain aging resistance and methods for making the same.

A high strength, dual phase (DP) steel with a low yield-to-tensile ratio, high uniform elongation, and high work hardening coefficient and methods for making the same are provided. Such steel can be post-treated without adversely affecting its strain capacity. The steel is suitable for linepipe, offshore structures, oil and gas production facilities, and pressure vessels, among many other uses commonly known for steel.

In one or more embodiments, the steel includes iron and a balance of alloying elements that reduces the degree of supersaturation of carbon and nitrogen in the ferritic phases of the steel, thereby providing resistance to strain aging. Preferably, the solute carbon content in the ferritic phase is less than 0.01 wt %, more preferably less than 0.005 wt %. In one or more embodiments, the solute carbon content is between 0.005 wt % and 0.01 wt %. In one or more embodiments, the solute carbon content is about 0.006 wt %, about 0.007 wt %, about 0.008 wt %, or about 0.009 wt %. Preferably, the solute nitrogen content in the ferritic phase is less than 0.01 wt %, more preferably less than 0.005 wt %. In one or more embodiments, the solute nitrogen content is between 0.005 wt % and 0.01 wt %. In one or more embodiments, the solute nitrogen content is about 0.006 wt %, about 0.007 wt %, about 0.008 wt %, or about 0.009 wt %.

Preferably, the steel is formulated to have a tensile strength in pipe before and after heating for a treatment process, such as a anti-corrosion coating treatment process, that exceeds 500 MPa, more preferably 520 MPa or more. The steel is also formulated to have a minimum yield strength of about 400 MPa, more preferably a minimum yield strength of about 415 MPa. The steel is also formulated to provide a precursor steel and linepipe fabricated therefrom, both before and after heating for a treatment process, having a yield to tensile strength (YTS) ratio or yield ratio (YR) of about 0.90 or less, preferably about 0.85 or less, even more preferably about 0.8 or less. In one or more embodiments, the YR is 0.89 or 0.88 or 0.87 or 0.86 or 0.85. The steel is also formulated to have a minimum uniform elongation exceeding about 8%, preferably more than about 10% in the precursor steel and linepipe fabricated therefrom, both before and after heating for a treatment process. Further, the steel is formulated to have a high toughness such as more than about 120 J in Charpy-V-Notch test at −12° C., preferably exceeding about 200 J in Charpy-V-Notch test at −12° C., even more preferably exceeding about 250 J in Charpy-V-Notch test at −12° C.

Preferred alloying elements and preferred ranges are described in further detail below. For example, the steel preferably has a carbon content less than 0.12 wt %, more preferably less than 0.10 wt % and most preferably less than 0.08 wt %. In one or more embodiments, the carbon content ranges from a low of about 0.05 wt %, 0.06 wt %, 0.07 wt % to a high of about 0.10 wt %, 0.11 wt %, 0.12 wt %. Preferably, the steel has a carbon content of from 0.05 wt % to 0.12 wt %.

In one or more embodiments above or elsewhere herein, the steel can include silicon (Si). Silicon can be added for de-oxidation purposes. Silicon is also a strong matrix strengthener, but it has a strong detrimental effect on both base steel and HAZ toughness. Therefore, an upper limit of 0.5 wt % is preferred for silicon. Silicon increases the driving force for carbon migration into the untransformed austenite during the cool down (quenching) of the steel plate from high temperature and in this sense reduces the interstitial content of ferrite and improves its flow and ductility. This beneficial effect of silicon should be balanced with its intrinsic effect on degrading the toughness of the steel. Due to these balancing forces, an optimum silicon addition in the alloys of this invention is between about 0.01 wt % to 0.5 wt %.

In one or more embodiments above or elsewhere herein, the steel can include manganese (Mn). Manganese can be a matrix strengthener in steels and more importantly, can contribute to hardenability. Manganese is an inexpensive alloying addition to prevent excessive ferrite formation in thick section plates especially at mid-thickness locations of these plates which can lead to a reduction in plate strength. Manganese, through its strong effect in delaying ferrite, pearlite, granular bainite and upper bainite transformation products of austenite during its cooling, provides processing flexibility for producing the alternate strong second phases in the microstructure such as lath martensite, lower bainite and degenerate upper bainite. However, too much manganese is harmful to steel plate toughness, so an upper limit of about 2.0 wt % manganese is preferred. This upper limit is also preferred to substantially minimize centerline segregation that tends to occur in high manganese and continuously cast steel slabs and the attendant poor microstructure and toughness properties in the center of the plate produced from the slab. Preferably, the steel has a Mn content of from about 0.5 wt % to about 2.0 wt %.

Preferably, residuals are minimized. For example, sulfur (S) content is preferably less than about 0.01 wt %. Phosphorus (P) content is preferably less than about 0.015 wt %. More preferably, the P content is less than 0.01 wt %. In one or more embodiments, the P content ranges from 0.0001 wt % to 0.009 wt %, if present.

In one or more embodiments above or elsewhere herein, the steel can include niobium (Nb). Niobium can be added to promote grain refinement during hot rolling of the steel slab into plate which in turn improves both the strength and toughness of the steel plate. Niobium carbide precipitation during hot rolling serves to retard recrystallization and to inhibit grain growth, thereby providing a means of austenite grain refinement. For these reasons, at least 0.005 wt % niobium is preferred. Niobium is also a strong hardenability enhancer and provides precipitation strengthening in the HAZ through formation of niobium carbides or carbonitrides. These effects of niobium addition to steel are useful to minimize HAZ softening, particularly next to the fusion line, in high strength steel weldments. For this reason a minimum of 0.01 wt % niobium is more preferred in steel plates subjected to welding during fabrication into useful objects such as linepipe. However, higher niobium can lead to excessive precipitation strengthening and consequently, degrade toughness in both the base steel and especially in the HAZ. For these reasons, an upper limit of 0.03 wt % is preferred. More preferably, the upper limit is 0.02 wt %.

In one or more embodiments above or elsewhere herein, the steel can include titanium (Ti). Titanium is effective in forming fine titanium nitride (TiN) precipitates which refine the grain size in both the rolled structure and the HAZ of the steel. Thus, the toughness of the steel and HAZ are improved. A minimum of 0.005 wt % titanium is preferred for this purpose. Titanium is added to the steel in such an amount that the weight ratio of Ti/N is preferably about 3.4. Excessive titanium additions to the steel tend to deteriorate the toughness of the steel by forming coarse TiN particles or titanium carbide particles. Thus, the upper limit for titanium is preferably 0.02 wt %.

In one or more embodiments above or elsewhere herein, the steel can include aluminum (Al). Aluminum can be added primarily for deoxidation of the steel. At least 0.01 wt % aluminum is preferred for this purpose. Small amounts of aluminum in the steel are also beneficial for HAZ properties by tying up free nitrogen that comes about from dissolution of nitride and carbonitride particles in the coarse grain HAZ due to the intense thermal cycles of the welding process. However, aluminum is similar to silicon in reducing the deformation and toughness properties of the matrix. In addition, higher aluminum additions lead to excessive, coarse aluminum-oxide inclusions in the steel which degrade toughness. Hence, an upper limit of 0.1 wt % is preferred for aluminum additions to the steel.

In one or more embodiments above or elsewhere herein, the steel can include nitrogen (N). Nitrogen can inhibit coarsening of austenite grains during slab reheating and in the HAZ by forming TiN precipitates and thereby enhancing the low temperature toughness of base metal and HAZ. For this effect a minimum of 0.0015 wt % nitrogen is preferred. However, too much nitrogen addition can lead to excessive free nitrogen in the HAZ and degrade HAZ toughness. Excessive free nitrogen can also increase the propensity for strain aging in the linepipe. For this reason, the upper limit for nitrogen is preferably 0.01 wt %, more preferably 0.005 wt %

In one or more embodiments above or elsewhere herein, the steel has a nitrogen content less than 0.01 wt %, more preferably less than 0.0075 wt % and most preferably less 0.005 wt %. Preferably, the nitrogen content ranges from a low of about 0.0025 wt %, 0.0035 wt %, or 0.0045 wt % to a high of 0.0050 wt %, 0.0075 wt %, or 0.01 wt %. More preferably, the steel has a nitrogen content of from about 0.0025 wt % to about 0.0095 wt %.

In one or more embodiments above or elsewhere herein, the steel can include nickel (Ni). Nickel can enhance the toughness of the base steel as well as the HAZ. A minimum of 0.1 wt % nickel and more preferably, a minimum of 0.3 wt % nickel is preferred to produce significant beneficial effect on the HAZ and base steel toughness. Although not to the same degree as manganese and molybdenum additions, nickel addition to the steel promotes hardenability and, therefore, through thickness uniformity in microstructure and properties in thick sections (20 mm and higher). However, excessive nickel additions can impair field weldability (causing cold cracking), can reduce HAZ toughness by promoting hard microstructures, and can increase the cost of the steel. Preferably, the steel has a nickel content of about 1 wt % or less.

In one or more embodiments above or elsewhere herein, the steel has reduced amounts of or essentially no substitutional alloying elements such as chromium, molybdenum, vanadium, and copper, for example. Such elements lower the carbon and nitrogen activity in the ferritic phase of the steel or result in excessive precipitation hardening, which increase the propensity for strain aging. The combined content of molybdenum, chromium, vanadium and copper is about 0.20 wt % or less, about 0.15 wt % or less, about 0.12 wt % or less, or about 0.10 wt % or less.

In one or more embodiments above or elsewhere herein, the steel can include boron (B). Boron can greatly increase the hardenability of steel very inexpensively and promote the formation of steel microstructures of lower bainite, lath martensite even in thick sections (>16 mm). Boron allows the design of steels with overall low alloying and Pcm (welding hydrogen cracking susceptibility parameter based on composition) and thereby improve HAZ softening resistance and weldability. Boron in excess of about 0.002 wt % can promote the formation of embrittling particles of $Fe_{23}(C,B)_6$. Therefore, when Boron is added, an upper limit of 0.002 wt % boron is preferred. Boron also augments the hardenability effect of molybdenum and niobium.

In one or more embodiments above or elsewhere herein, the steel can include chromium (Cr). Chromium can have a strong effect on increasing the hardenability of the steel upon direct quenching. Thus, chromium is a cheaper alloying addition than molybdenum for improving hardenability, especially in steels without added boron. Chromium improves the corrosion resistance and hydrogen induced cracking resistance (HIC). Similar to molybdenum, excessive chromium tends to cause cold cracking in weldments, and tends to deteriorate the toughness of the steel and its HAZ. Chromium lowers carbon activity in ferrite and can thereby lead to an increase in the amount of carbon in solid solution, which can increase the steel's propensity for strain aging. So when chromium is added a maximum of 0.2 wt % is preferred and a maximum of 0.1 wt % is even more preferred.

In one or more embodiments above or elsewhere herein, the steel can include REM (rare earth metals). Calcium and REM suppress the generation of elongated MnS by forming sulfide and improve the properties of the steel plate (e.g. lamellar tear property). However, the addition of Ca and REM exceeding 0.01% deteriorates steel cleanliness and field weldability by forming CaO—CaS or REM-CaS. Preferably, no more than 0.02 wt % of REM is added.

In one or more embodiments above or elsewhere herein, the steel can include magnesium (Mg). Magnesium generally forms finely dispersed oxide particles, which can suppress coarsening of the grains and/or promote the formation of intra-granular ferrite in the HAZ and, thereby, improve HAZ toughness. At least about 0.0001 wt % Mg is desirable for the addition of Mg to be effective. However, if the Mg content exceeds about 0.006 wt %, coarse oxides are formed and the toughness of the HAZ is deteriorated. Accordingly, the Mg content is preferably less than 0.006 wt %.

In one or more embodiments above or elsewhere herein, the steel can include copper (Cu). Copper can contribute to strengthening of the steel via increasing the hardenability and through potent precipitation strengthening via ϵ-copper precipitates. At higher amounts, copper induces excessive precipitation hardening and if not properly controlled, can lower the toughness in the base steel plate as well as in the HAZ. Higher copper can also cause embrittlement during slab casting and hot rolling, requiring co-additions of nickel for mitigation. When copper is added in the present steels, an upper limit of 0.2 wt % is preferred, an upper limit of 0.1 wt % is even more preferred.

In one or more embodiments above or elsewhere herein, the steel can include vanadium (V). Vanadium has substantially similar, but not as strong of an effect as niobium. However, the addition of vanadium produces a remarkable effect when added in combination with niobium. The combined effect of vanadium and niobium greatly minimizes HAZ softening during high heat input welding such as seam welding in linepipe manufacture. Like niobium, excessive vanadium can degrade toughness of both the base steel as well as the HAZ through excessive precipitation hardening. Furthermore, vanadium like chromium and molybdenum has a strong affinity for carbon and nitrogen. In other words, vanadium can lower carbon activity in ferrite, causing an increase in the amount of carbon and nitrogen in solid solution, which can increase the steel's propensity for strain aging. Thus, vanadium when added to the steel is preferably less than about 0.1 wt % or even more preferably less than about 0.05 wt % or even more preferably less than about 0.03 wt %.

In one or more embodiments above or elsewhere herein, the steel can include zirconium (Zr), hafnium (Hf) and/or tantalum (Ta). Zirconium (Zr), hafnium (Hf) and tantalum (Ta) are like niobium (Nb), elements that form carbides and nitrides and are effective in enhancing strength. However, the effect cannot be realized with an addition less than 0.0001 wt %. Yet, the toughness of steel plates deteriorates with more than 0.05 wt %. Therefore, the Ta content is preferably less than about 0.03 wt %, and the Zr content is preferably less than about 0.03 wt % and the Hf content is less than about 0.03 wt %.

Preferably, the steel has a Pcm of less than 0.220, but more than 0.150. Pcm refers to a method of measuring the hardenablility and the weldability of steels based on the chemical composition. Higher concentrations of carbon and other alloying elements (e.g. Mn, Cr, Si, Mo, V, Cu, Ni) tend to increase the hardness and decrease the weldability of the steel. Since each of these materials tends to influence the hardness and weldability of the steel to different magnitudes, Pcm is a way to judge the difference in hardness/weldability between alloys made of different alloying elements. A commonly used formula for calculating the Pcm is:

$$Pcm = C + Si/30 + (Mn+Cu+Cr)/20 + Ni/60 + Mo/15 + V/10 + 5B$$

Microstructure

In one or more embodiments, the steel has a dual phase microstructure that includes from about 10 percent by volume to about 90 percent by volume of a softer, ferrite phase or constituent ("first phase") and from about 10 percent by volume to about 90 percent by volume of a stronger phase or constituent ("second phase"). The second phase can include one or more phases or constituents that are not ferrite. Illustrative non-ferrite phases or constituents include, but are not limited to, martensite, lower bainite, degenerate upper bainite, upper bainite, granular bainite, pearlite, carbides such as cementite and mixtures thereof.

$Ar_1$ transformation temperature refers to the temperature at which transformation of austenite to ferrite or to ferrite plus cementite is completed during cooling.

$Ar_3$ transformation temperature refers to the temperature at which austenite begins to transform to ferrite during cooling.

Cooling rate refers to the rate of cooling at the center, or substantially at the center, of the plate thickness.

Dual phase means at least two distinguishable phases or at least two distinguishable constituents.

Granular Bainite (GB) refers to a cluster of 3 to 5 relatively equiaxed bainitic ferrite grains that surround a centrally located, small "island" of Martensite-Austenite (MA). Typical "grain" diameters are about 1-2 μm.

Upper Bainite (UB) refers to a mixture of acicular or laths of bainitic ferrite interspersed with stringers or films of carbide phase such as cementite.

Degenerate Upper Bainite (DUB) is a bainitic product where each colony grows by shear stress into a set (packet) of parallel laths. During and immediately after lath growth, some carbon is rejected into the interlath austenite. Due to the relatively low carbon content, carbon enrichment of the entrapped austenite is not sufficient to trigger cementite plate nucleation. Such nucleation does occur in medium and higher carbon steels resulting in the formation of classical upper bainite (UB). The lower carbon enrichment at the interlath austenite in DUB, on the other hand, results in formation of martensite or martensite-austenite (MA) mixture or be retained as retained austenite (RA).

DUB can be confused with classical upper bainite (UB). UB of the type first identified in medium carbon steels decades ago consists of two key features; (1) sets of parallel laths that grow in packets, and (2) cementite films at the lath boundaries. UB is similar to DUB in that both contain packets of parallel laths; however, the key difference is in the interlath material. When the carbon content is about 0.15-0.40, cementite ($Fe_3C$) can form between the laths. These "films" can be relatively continuous as compared to the intermittent MA in DUB. For low carbon steels, interlath cementite does not form; rather the remaining austenite terminates as MA, martensite or RA.

Lower Bainite (LB) has packets of parallel laths. LB also includes small, intra-lath carbide precipitates. These plate-like particles consistently precipitate on a single crystallographic variant that is oriented at approximately 55° from the primary lath growth direction (long dimension of the lath).

Lath Martensite (LM) appears as packets of thin parallel laths. Lath width is typically less than about 0.5 μm. Untempered colonies of martensitic laths are characterized as carbide free, whereas auto-tempered LM displays intralath carbide precipitates. The intralath carbides in autotempered LM form on more than one crystallographic variant, such as on {110} planes of martensite. Often in the Transmission Electron Microscopy (TEM) of an autotempered LM, the cementite is not aligned along one direction, rather it precipitates on multiple planes.

Pearlite is typically a lamellar mixture of two-phases, made up of alternate layers of ferrite and cementite ($Fe_3C$).

Grain is an individual crystal in a polycrystalline material.

Grain boundary refers to a narrow zone in a metal corresponding to the transition from one crystallographic orientation to another, thus separating one grain from another.

Prior austenite grain size refers to an average austenite grain size in a hot-rolled steel plate prior to rolling in the temperature range in which austenite does not recrystallize.

Quenching refers to accelerated cooling by any means whereby a fluid selected for its tendency to increase the cooling rate of the steel is utilized, as opposed to air cooling.

Accelerated cooling finish temperature (ACFT) is the highest, or substantially the highest, temperature reached at the surface of the plate, after quenching is stopped, because of heat transmitted from the mid-thickness of the plate.

A slab is a piece of steel having any dimensions.

$T_{nr}$ temperature is the temperature below which austenite does not recrystallize.

Transverse direction refers to a direction that is in the plane of rolling but perpendicular to the plate rolling direction.

Method for Making

In one or more embodiments, the steel composition is processed in a manner to reduce the amount of C and/or N supersaturation in the ferrite phase of the dual phase steel resulting therefrom. Preferably, the steel is processed at conditions sufficient to allow C and N to diffuse out of ferrite and/or precipitate out during plate processing. The diffusion and precipitation can be accomplished through high accelerated cooling finish temperatures while retaining all the desired microstructure features (e.g. the amount of softer ferrite phase, the effective prior austenite grain size, etc.) of the dual phase microstructure design. In one or more embodiments, the volume percent of ferrite in the steel is of from about 10 wt % to 90 wt %, more preferably of from about 30 wt % to 80 wt %. Preferably, the ferrite is uniformly dispersed throughout the steel.

The steel composition is preferably processed into dual phase plates using a two step rolling process. In one or more embodiments, a steel billet/slab from the compositions described is first formed in normal fashion such as through a continuous casting process. The billet/slab can then be re-heated to a temperature ("reheat temperature") within the range of about 1,000° C. to about 1,250° C. Preferably, the reheat temperature is sufficient to (i) substantially homogenize the steel slab, (ii) dissolve substantially all the carbide and carbonitrides of niobium and vanadium, when present, in the steel slab, and (iii) establish fine initial austenite grains in the steel slab. The re-heated slab is then hot rolled in one or more passes in a first reduction providing about 30% to about 90% reduction at a first temperature range where austenite recrystallizes. Next, the reduced billet is hot rolled in one or more passes in a second rolling reduction providing about 40-80% reduction at a second and somewhat lower temperature range wherein austenite does not recrystallize but above the $Ar_3$ transformation point. Preferably, the cumulative rolling reduction below the Tnr temperature is at least 50%, more preferably at least about 70%, even more preferably at least 75%.

The second rolling reduction is completed at "finish rolling temperature". In one or more embodiments, the finish rolling temperature is above 700° C., preferably above 720° C., more preferably above 770° C. In one or more embodiments, the finish rolling temperature ranges from about 700 to 800° C. Thereafter, the hot rolled plate is cooled (e.g. in air) to a first cooling temperature or accelerated cooling start temperature ("ACST") that is sufficient to induce austenite to ferrite transformation followed by an accelerated cool at a rate of at least 10° C. per second to a second cooling temperature or accelerated cooling finish temperature ("ACFT"). After the ACFT, the steel plate can be cooled to room temperature (i.e. ambient temperature) in ambient air. Preferably, the steel plate is allowed to cool on its own to room temperature.

In one or more embodiments, the ACST is about 600° C. or more, about 650° C. or more, about 700° C. or more, or about 730° C. or more. In one or more embodiments, the ACST can range from about 600° C. to about 800° C. In one or more embodiments, the ACST can range from about 650° C. to about 750° C. Preferably, the ACST ranges from a low of about 650° C., 660° C., or 690° C. to a high of about 700° C., 730° C., or 750° C. In one or more embodiments, the ACST can be about 650° C., about 660° C., about 670° C., about 680° C., about 690° C., about 700° C., about 710° C., about 720° C., about 730° C., about 740° C., or about 750° C.

In one or more embodiments, the ACFT can range from about 400° C. to about 700° C. In one or more embodiments, the ACFT can range from about 450° C. to about 650° C. Preferably, the ACFT ranges from a low of about 400° C., 450° C., or 500° C. to a high of about 550° C., 600° C., or 650° C. For example, the ACFT can be about 505° C., about 510° C., about 515° C., about 520° C., about 525° C., about 530° C., about 535° C., about 540° C., to 550° C., or about 575° C. In one or more embodiments, the ACFT can range from about 540° C. to about 560° C.

Not wishing to be bound by theory, it is believed that the high accelerated cooling finish temperature ("ACFT") allows at least a portion of the carbon and nitrogen atoms to diffuse from the ferrite phase of the steel composition to the second phase. It is further believed that the high accelerated cooling finish temperature ("ACFT") allows at least a portion of the carbon and nitrogen atoms to precipitate out of the ferrite phase as carbides, carbonitrides, and/or nitrides during subsequent cooling to the ambient from the ACFT. As such, the amount of free C and N in the interstices of the ferrite phase is reduced, reducing the amount of C and N available to migrate to dislocations in the ferrite. Therefore, the steel's propensity to strain age is reduced, if not eliminated.

Following the rolling and cooling steps, the plate can be formed into pipe (e.g. linepipe). Any method for forming pipe can be used. Preferably, the precursor steel plate is fabricated into linepipe by a conventional UOE process which is well known in the art.

FBE Process

Following the formation of the pipe, the pipe can then undergo a coating/painting step to prevent corrosion and/or mechanical damage. The coating process can include one or more polymer coatings applied to at least the outer diameter or surface of the pipe. The coating can also be applied to both the inner and outer surfaces of the pipe. Illustrative coatings include but are not limited to fusion bonded epoxy (FBE), polypropylene, polyethylene, and polyurethane. Preferably, fusion bonded epoxy (FBE) is applied. FBE is a thermoset polymer that can be sprayed onto the pipe using known techniques and heat cured. Preferably, at least one layer of FBE is applied or sprayed onto the pipe. In one or more embodiments, each layer of coating has a thickness between about 2 microns and 75 mm. In one embodiment, the pipe can be heated and rotated during the application of a spray powder. In another embodiment, the pipe can be heated and submerged in a fluidized bed containing the polymer. Preferably, the pipe is heated to a temperature between about 180° C. and about 300° C. One or more other coatings can then be applied to at least a portion of the pipe over the FBE layer.

As mentioned above, a post treatment step, such as a FBE application process, facilitates the diffusion of the supersaturated carbon and nitrogen atoms, leading to the formation of solute atmospheres around dislocations in the steel. The formation of these solute atmospheres ("Cottrell atmospheres") increases the strength of the steel but decreases ductility since more strain or force is required to break the atmospheres away from the dislocations. As a result, the steel becomes less ductile and can be unsuitable for use in regions requiring high strain capacity.

End Uses

Steel plates made according the embodiments described retain all the desired microstructure features of a dual phase microstructure design but minimize the carbon supersaturation in the ferrite phase. Such DP steel can be readily implemented in applications where both high strength and high strain capacity are required. For example, the steel is particularly useful as a precursor for making linepipe or pressure vessels. The steel can also be used for offshore structures including risers, oil and gas production facilities, chemicals production facilities, ship building, automotive manufacturing, airplane manufacturing, and power generation.

To facilitate a better understanding of the present invention, the following examples of certain aspects of some embodiments are given. In no way should the following examples be read to limit, or define, the scope of the invention.

EXAMPLES

The foregoing discussion can be further described with reference to the following non-limiting examples.

Four steel precursors (Steels A, B, C, D, and E) were prepared from heats having the chemical compositions shown in Table 1. Each precursor was prepared by vacuum induction, melting 150 kg heats and casting into slabs or by using a 250 ton industrial basic oxygen furnace and continuously casting into steel slabs. Steel plates (Examples 1-8) were prepared from these steel precursors (Steels A, B, C, D, and E) according to the process conditions summarized in Table 2. Examples 1-7 represent the inventive steels while Example 8 represents a comparative or conventional DP steel.

TABLE 1

| Steel Compositions (wt. %) | | | | | | | | | | | | | | | | |
|---|---|---|---|---|---|---|---|---|---|---|---|---|---|---|---|---|
| Steel | C | Mn | P* | S* | Si | Cu | Ni | Cr | Mo | Nb | V | Ti* | T.Al* | B* | CE | Pcm |
| A | 0.050 | 1.48 | 60 | 10 | 0.15 | 0.25 | 0.40 | 0.03 | 0.10 | 0.010 | — | 120 | 300 | — | 0.39 | 0.157 |
| B | 0.070 | 1.60 | 70 | 10 | 0.29 | 0.01 | 0.01 | 0.03 | 0.19 | 0.030 | 0.020 | 130 | 300 | — | 0.43 | 0.177 |
| C | 0.068 | 1.47 | 90 | 20 | 0.09 | — | 0.30 | — | 0.11 | 0.011 | — | 120 | 220 | — | 0.38 | 0.161 |
| D | 0.078 | 1.59 | 120 | 20 | 0.13 | — | 0.30 | — | — | 0.011 | — | 130 | 220 | — | 0.39 | 0.169 |
| E | 0.070 | 1.72 | 100 | 20 | 0.10 | 0.01 | 0.32 | 0.03 | — | 0.010 | — | 100 | 240 | 1 | 0.39 | 0.170 |

*ppm

CE = C + Mn/6 + (Cu + Ni)/15 + (Cr + Mo + V)/5

Pcm = C + Si/30 + (Mn + Cu + Cr)/20 + Ni/60 + Mo/15 + V/10 + 5B

TABLE 2

Processing conditions for steel plates

| Example | Steel Composition | Reheat Temp. (° C.) | Finish Rolling Temp. (° C.) | Cooling Start Temp. (° C.) | Cooling Finish Temp. (° C.) |
|---|---|---|---|---|---|
| 1 | Steel A | 1070 | 711 | 681 | 556 |
| 2 | Steel B | 1080 | 763 | 723 | 548 |
| 3 | Steel C | 1150 | 730 | 688 | 558 |
| 4 | Steel D | 1150 | 716 | 684 | 528 |
| 5 | Steel D | 1150 | 730 | 691 | 566 |
| 6 | Steel D | 1150 | 725 | 687 | 588 |
| 7 | Steel E | 1060 | 716 | 682 | 536 |
| 8 | Steel A | 1070 | 719 | 680 | 338 |

After processing the steel into precursor plates, the steel plates were formed into linepipe. Heat-treatment on the formed pipe was carried out for 5 to 8 minutes at 200° C. to 250° C. to simulate the FBE coating process as listed in Table 3. The term "As-UOE" as used in Table 3 refers to the linepipe at room temperature, i.e. without the heat treatment. Mechanical properties of the pipes for longitudinal direction were measured and are also reported in Table 3.

TABLE 3

Mechanical properties of the pipe

| Example | Heat Treatment Temp. (° C.) | Yield Strength (MPa) | Tensile Strength (MPa) | Yield Ratio (%) | Uniform elongation (%) |
|---|---|---|---|---|---|
| 1 | As-UOE | 447 | 513 | 87.0 | 11.3 |
| | 220 | 457 | 521 | 87.7 | 10.3 |
| | 250 | 468 | 521 | 89.8 | 10.2 |
| 2 | As-UOE | 435 | 564 | 77.1 | 12.1 |
| | 220 | 476 | 578 | 82.4 | 10.5 |
| | 250 | 498 | 589 | 84.6 | 9.9 |
| 3 | As-UOE | 452 | 530 | 85.3 | 12.8 |
| | 235 | 480 | 537 | 89.4 | 10.3 |
| | 250 | 490 | 536 | 91.3 | 11.4 |
| 4 | As-UOE | 486 | 577 | 84.2 | 11.5 |
| | 235 | 489 | 566 | 86.4 | 9.2 |
| | 250 | 491 | 564 | 87.0 | 10.5 |
| 5 | As-UOE | 451 | 540 | 83.5 | 12.1 |
| | 235 | 453 | 545 | 83.1 | 11.4 |
| | 250 | 473 | 547 | 86.5 | 11.6 |
| 6 | As-UOE | 426 | 519 | 82.1 | 14.6 |
| | 235 | 443 | 526 | 84.2 | 12.5 |
| | 250 | 441 | 520 | 84.8 | 13.2 |
| 7 | As-UOE | 437 | 537 | 81.4 | 12.5 |
| | 250 | 472 | 553 | 85.4 | 11.9 |
| 8 | As-UOE | 478 | 656 | 72.9 | 10.7 |
| | 200 | 586 | 673 | 87.0 | 10.1 |
| | 250 | 597 | 677 | 87.3 | 8.9 |

Figure 2:
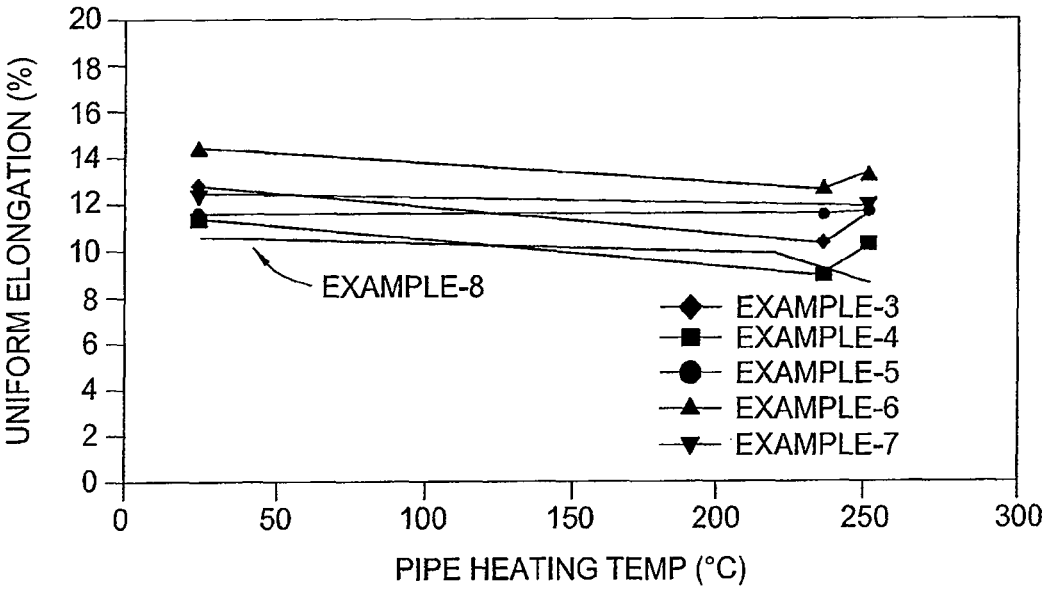
Figure 3:
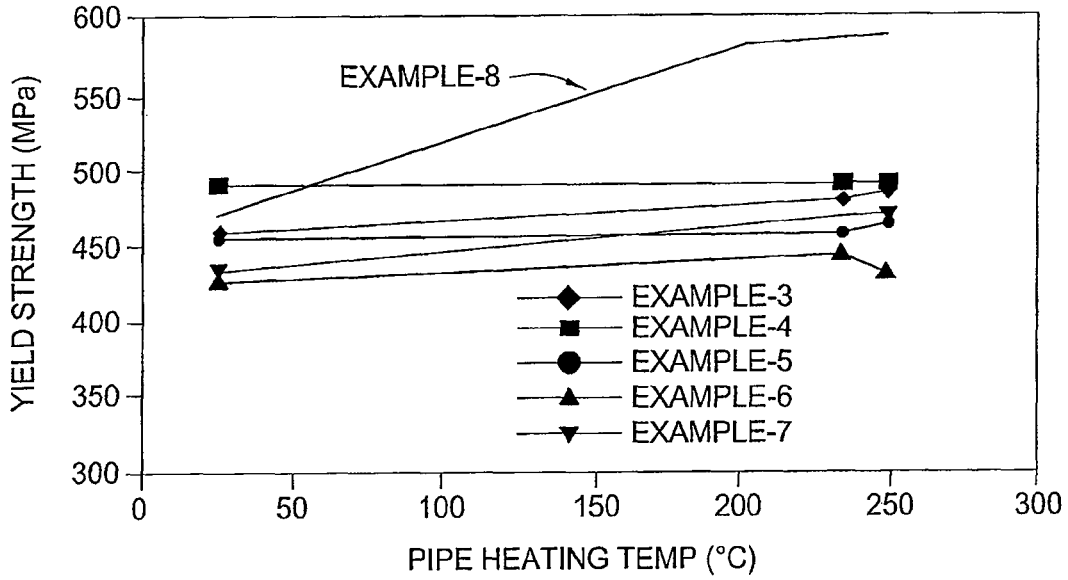
Figure 4:
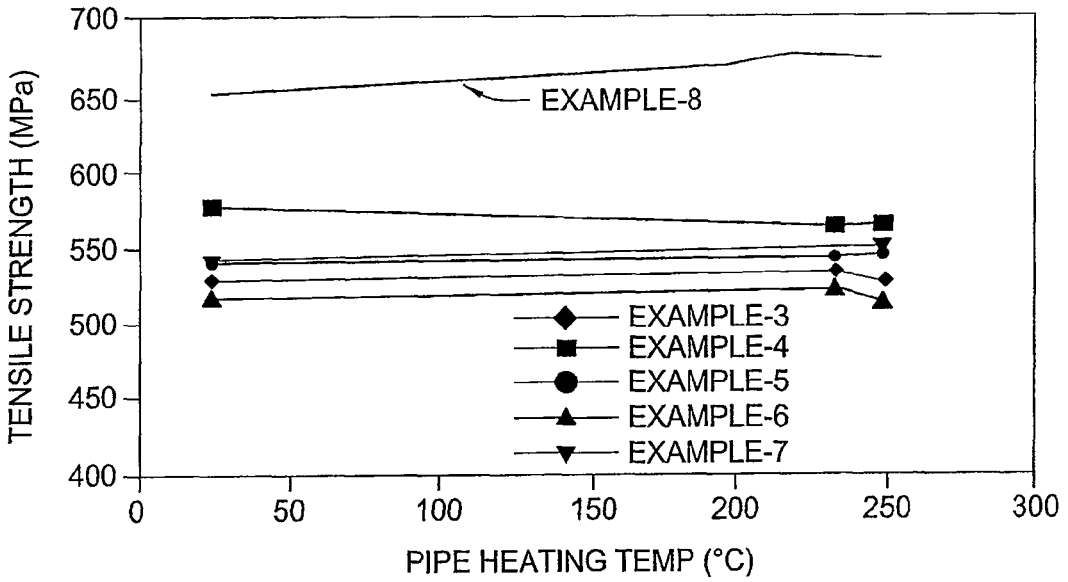

FIGS. 1-4 show the variations of the mechanical properties listed in Table 3 as a function of heat treatment temperature. In particular, FIGS. 1 and 2 show the inventive steels (Examples 3-7) exhibited much improved strain aging resistance, i.e. lower YR values (FIG. 1) and higher uniform elongation (FIG. 2), than the comparative steel, Example 8. All the while, the inventive steels (Examples 3-7) exhibited good, consistent yield strength (FIG. 3) and tensile strength (FIG. 4). As such, the DP steels produced according to embodiments described did not suffer from significant strain aging in contrast to the comparative DP steel (Example 8).

Figure 5:
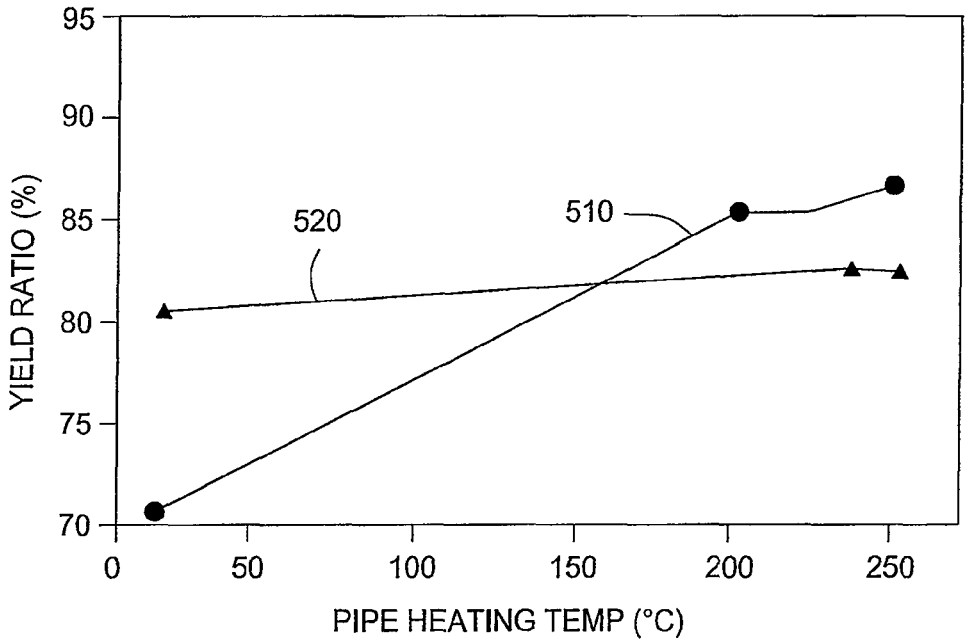
FIG. 5 shows the relationship between yield ratio (%) as a function of heat treatment temperature for steels produced according to one or more embodiments of the present invention and conventional steel.

FIG. 5 shows the relationship between yield ratio (%) as a function of heat treatment temperature for steels produced according to embodiments described (e.g. Examples 1-7) and conventional steel (e.g. Example 8). Curve 510 represents Example 8 and curve 520 is Example 6. As shown in FIG. 5, the inventive steel 520 shows much improved strain aging resistance, i.e. lower yield ratios in the temperature range typical of a FBE coating process (e.g. about 200° C. to about 250° C.), compared to the conventional DP steel 510.

Figure 6A:
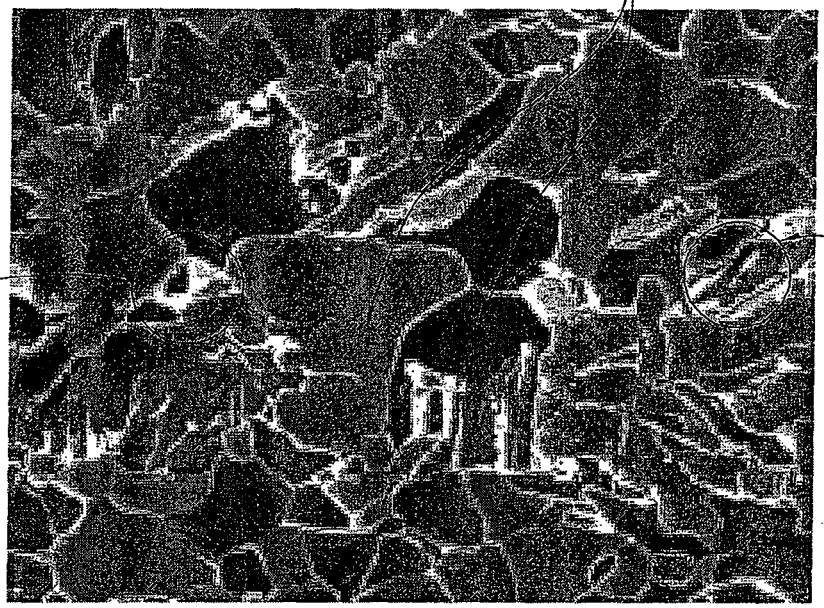
FIG. 6A is a scanning electron microscope (SEM image) of a heat treated conventional steel plate.
Figure 6B:
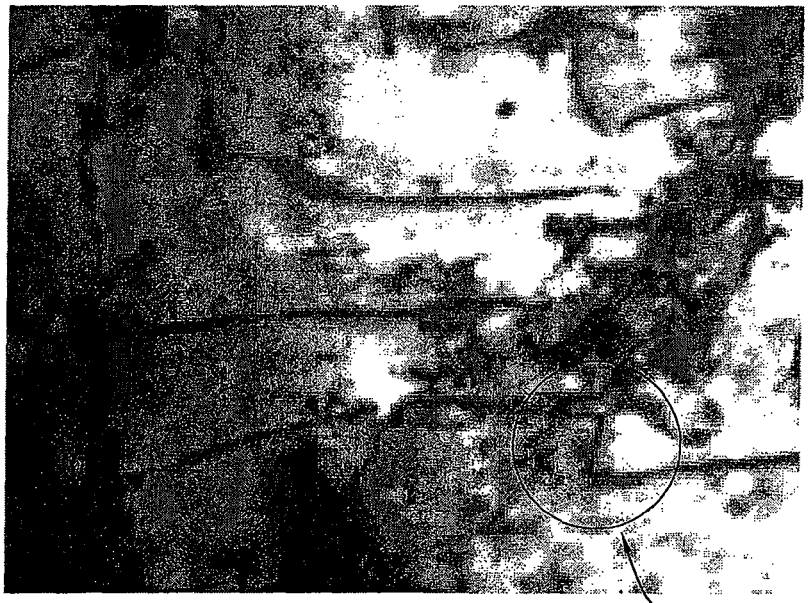
FIG. 6B is a transmission electron microscope (TEM) image of the heat treated conventional steel plate shown in FIG. 6A.

FIG. 6A, for example, is a SEM image of the steel produced in Example 8. FIG. 6B is a TEM image of Example 8 at quarter thickness. In both FIGS. 6A and 6B, the steel had been heat treated for an FBE coating simulation according to the conditions listed in Table 3. The steel had a first phase of ferrite 600 and a second phase of predominantly granular bainite (GB) 605 and degenerate upper bainite (DUB) 610. Referring to FIG. 6B, the dislocations 650 in the ferrite appeared primarily straight with some kinks, indicating that these dislocations 650 are less mobile under strain. As such, higher energy or greater force was needed to move or tear the dislocations 650. Such additional force, therefore, increased the strength of the steel, but decreased ductility as shown in Table 3.

Figure 7A:
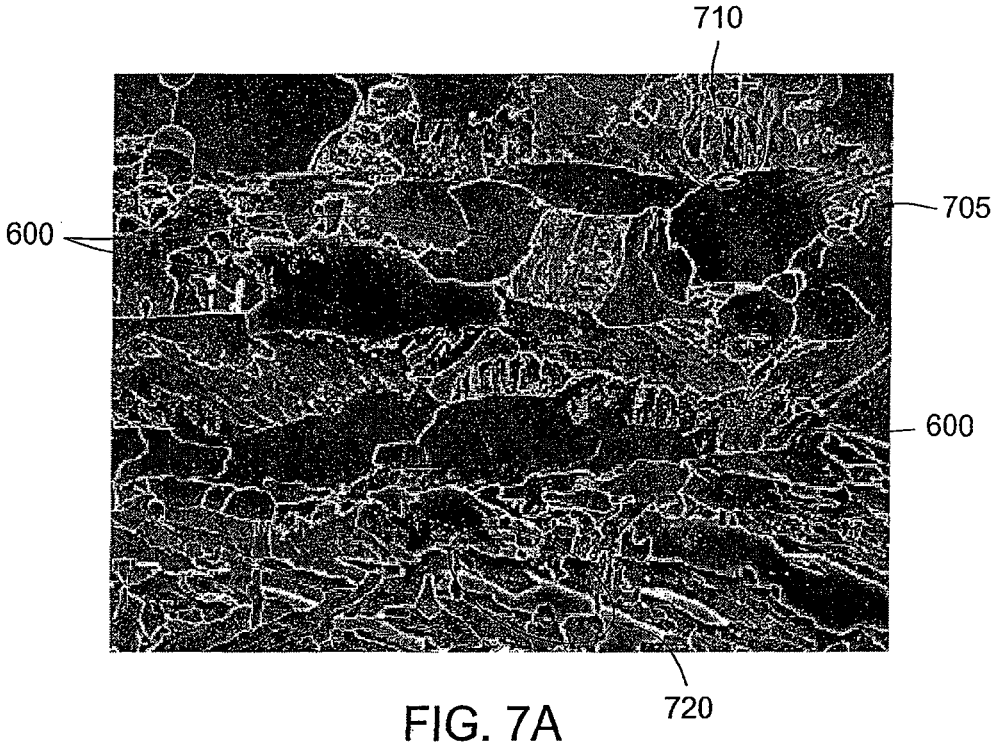
FIG. 7A is a SEM image of a steel plate at quarter thickness produced according to one or more embodiments of the present invention. The image shows the steel having a second phase that is predominantly granular bainite (GB), upper bainite (UB) or pearlite with some lath martensite (LM).
Figure 7B:
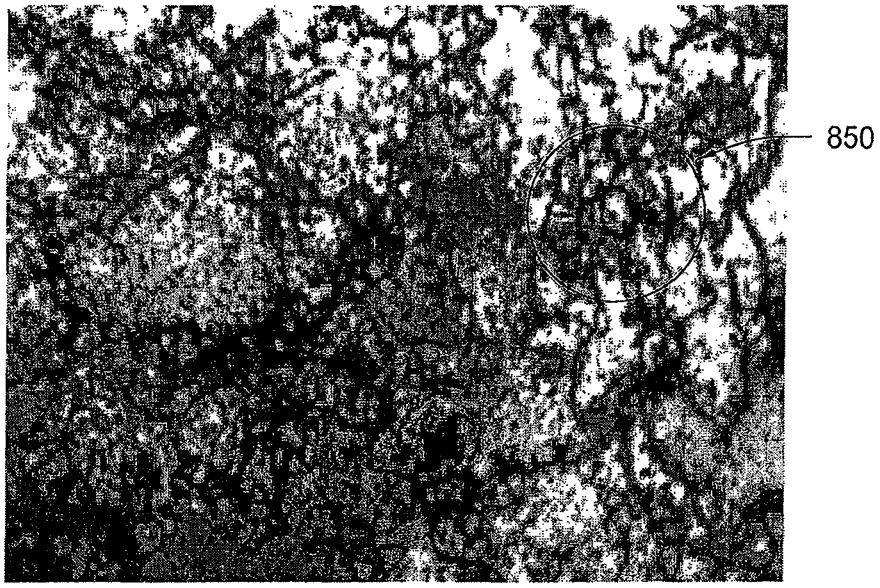
FIG. 7B is a TEM image at quarter thickness of the steel plate shown in FIG. 7A. The image shows the steel having tangled or wavy dislocations that indicate little or no carbon and/or nitrogen supersaturation.

FIG. 7A shows a SEM image of an inventive steel, Example 5 (Steel D with 566° C. cooling finish temperature) at quarter thickness. FIG. 7B shows a TEM image of the same steel. Again, both the SEM and TEM are images after the steel has been heated to simulate an FBE coating process according to the conditions listed in Table 3. FIG. 7A shows the second phase of the steel was predominantly granular bainite (GB) 705, upper bainite or pearlite 710 with some lath martensite (LM) 720. TEM images (not shown) of the steel shown in FIG. 7A actually reveal the constituent marked as 710 as more likely being pearlite. FIG. 7B shows the dislocations 850 were tangled, curved, and/or wavy, indicating high mobility of these dislocations upon straining. In other words, less force was needed to move the C and/or N atoms from the dislocations 850. Therefore, the ductility of the steel was increased and the tensile strength was unaffected as shown in Table 3.

As shown in FIGS. 1-7 and Table 3, Steels B, C, D, and E processed according to embodiments described herein each contained increased carbon and manganese content to maintain tensile strength, but were much less affected by strain aging compared to Steel A processed according to Example 8. One would have expected that the increased carbon content in Steels B, C, D, and E would have negatively affected strain aging. Surprisingly, the opposite was found true. Furthermore, one would have expected that the combination of increased carbon and manganese contents of Steels B, D, and E would have negatively affected strain aging even more than just the increased carbon content alone. Surprisingly, the opposite was found true. Therefore, it is believed that the absence of carbon-cluster forming alloys and/or a cooling finish temperature above 528° C. surprisingly provided dual phase steel pipes having good tensile and yield strengths in addition to a high resistance to strain aging.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A method for preparing a dual phase steel, comprising:

heating a steel slab to a reheating temperature from about 1,000° C. to about 1,250° C., wherein the heating of the steel slab at the reheating temperature provides a steel slab consisting essentially of an austenite phase;

reducing the steel slab to form a plate in at least one hot rolling pass at a first temperature, wherein the first temperature is sufficient to recrystallize the austenite phase;

reducing the plate in at least one hot rolling pass at a second temperature, wherein the second temperature is from about 700° C. to about 800° C. and wherein the austenite phase does not recrystallize at the second temperature;

cooling the plate to a first cooling temperature sufficient to transform an austenite to a ferrite;

reducing cluster forming atoms within the ferrite;

wherein reducing cluster forming atoms within the ferrite comprises quenching the cooled plate at a rate of at least 10° C. per second to a second cooling temperature and subsequently allowing the steel plate to cool to room temperature in ambient air, wherein the second cooling temperature is from about 450° C. to about 700° C.;

forming a linepipe from the plate, wherein the linepipe is formed from the plate using a UOE technique; and applying a coating for corrosion resistance to at least a portion of the linepipe.

2. The method of claim 1, wherein the cluster forming atoms comprise carbon.

3. The method of claim 1, wherein the cluster forming atoms comprise nitrogen.

4. The method of claim 1, wherein the cluster forming atoms comprise carbon and nitrogen.

5. The method of claim 1, wherein the first cooling temperature is from about 650° C. to about 750° C.

6. The method of claim 1, wherein the first cooling temperature is from about 660° C. to about 750° C.

7. The method of claim 1, wherein the first cooling temperature is from about 670° C. to 740° C.

8. The method of claim 1, wherein the first cooling temperature is about 730° C.

9. The method of claim 1, wherein the second cooling temperature is from about 450° C. to about 650° C.

10. The method of claim 1, wherein the second cooling temperature is from about 500° C. to about 600° C.

11. The method of claim 1, wherein the second cooling temperature is about 560° C.

12. The method of claim 1, wherein the rolled plate comprises of from about 10% by volume to about 90% by volume of the ferrite.

13. The method of claim 1, wherein the rolled plate comprises of from about 10% by volume to about 90% by volume of a second phase.

14. The method of claim 13, wherein the second phase comprises one or more constituents selected from the group consisting of carbide, pearlite, martensite, lower bainite, granular bainite, upper bainite, and degenerate upper bainite.

15. The method of claim 1, wherein the coating comprises at least one fusion bonded epoxy compound.

16. The method of claim 1, wherein the linepipe has a uniform elongation of 9.0% or more both before and after heating between about 180° C. and 250° C.

17. The method of claim 1, wherein the plate has a thickness of 20 mm or more.

18. The method of claim 1, wherein the plate has a thickness of 16 mm or more.

19. The method of claim 1, wherein the plate is formed into the linepipe following the rolling and cooling steps.

20. The method of claim 1, wherein the steel includes niobium in an amount of about 0.005 wt % to about 0.03 wt %; titanium in an amount of about 0.005 wt % to about 0.02 wt % and nickel in an amount of about 0.1 wt % to about 1 wt %, and the combined content of molybdenum, chromium, vanadium and copper is about 0.2 wt % or less.

21. The method of claim 20, wherein the cluster forming atoms within the ferrite are reduced such that the increase of yield strength by a coating process including heating the pipe to a range of from approximately 200° C. to approximately 250° C. is 5 MPa to 38 MPa.

22. The method of claim 1, wherein the cluster forming atoms within the ferrite are reduced such that the increase of yield strength by a coating process including heating the pipe to a range of from approximately 200° C. to approximately 250° C. is 5 MPa to 63 MPa.

23. A method for preparing a dual phase steel, comprising:

heating a steel slab to from about 1,000° C. to about 1,250° C. to provide a steel slab consisting essentially of an austenite phase;

reducing the steel slab to form a plate in at least one hot rolling pass at a temperature sufficient to recrystallize the austenite phase to produce a fine grained austenite phase;

reducing the plate in at least one hot rolling pass at a finish rolling temperature, wherein the finish rolling temperature is from about 700° C. to about 800° C.;

cooling the plate to a first temperature sufficient to transform an austenite to a ferrite;

quenching the plate at a rate of at least 10° C. per second (18° F./sec) to a second temperature, wherein the second temperature is from about 450° C. to about 700° C.;

allowing the plate to cool to room temperature in ambient air;

forming a linepipe from the plate, wherein the linepipe is formed from the plate using a UOE technique;

heating the linepipe to a temperature between about 180° C. and 300° C.; and applying at least one coating to at least a portion of the linepipe, wherein the steel comprises carbon in an amount less than 0.08 wt %, manganese in an amount of about 1.59 wt % or less, nickel in an amount of about 1 wt % or less, and the combined content of molybdenum, chromium, vanadium and copper is about 0.10 wt % or less.

24. The method of claim 23, wherein the second temperature is sufficient to diffuse the carbon from the ferrite to a second phase.

25. The method of claim 24, wherein the second phase comprises one or more constituents selected from the group consisting of carbide, pearlite, martensite, lower bainite, granular bainite, upper bainite, and degenerate upper bainite.

26. The method of claim 23, wherein the second temperature is sufficient to precipitate out the carbon in the ferrite into one or more carbides.

27. The method of claim 23, wherein the first temperature is from about 650° C. to about 750° C.

28. The method of claim 23, wherein the first temperature is from about 670° C. to about 740° C.

29. The method of claim 23, wherein the second temperature is from about 450° C. to about 650° C.

30. The method of claim 23, wherein the second temperature is from about 500° C. to about 600° C.

31. The method of claim 23, wherein the second temperature is about 560° C.

32. The method of claim 23, wherein the at least one coating comprises one or more fusion bonded epoxy compounds.

33. The method of claim 23, wherein the linepipe has a uniform elongation of 9.0% or more both before and after heating between about 180° C. and 250° C.

34. The method of claim 23, wherein the plate has a thickness of 20 mm or more.

35. The method of claim 23, wherein the plate has a thickness of 16 mm or more.

36. The method of claim 23, wherein the plate is formed into the linepipe following the rolling and cooling steps.

37. The method of claim 23, wherein the steel includes niobium in an amount of about 0.005 wt % to about 0.03 wt %; titanium in an amount of about 0.005 wt % to about 0.02 wt % and nickel in an amount of about 0.1 wt % to about 1 wt %.

* * * * *